United States Patent [19]

Johnson

[11] Patent Number: 4,591,071

[45] Date of Patent: May 27, 1986

[54] SQUIRT GUN

[76] Inventor: Lonnie G. Johnson, 1463 E. Barkley Dr., Mobile, Ala. 36606

[21] Appl. No.: 541,898

[22] Filed: Oct. 14, 1983

[51] Int. Cl.[4] ..... B67D 5/32

[52] U.S. Cl. ..... 222/39; 222/79; 222/401; 340/384 E; 340/406; 116/137 R

[58] Field of Search ..... 340/384 E, 406; 116/137 R, 139; 222/39, 79, 323, 324, 401

[56] References Cited

U.S. PATENT DOCUMENTS

| | | | |
|---|---|---|---|
| 1,333,704 | 3/1920 | Brinks | 340/406 |
| 2,249,608 | 7/1941 | Greene | 222/79 |
| 2,302,963 | 11/1942 | Lefever | 222/39 |
| 2,589,977 | 3/1952 | Stelzer | 222/79 |
| 3,202,318 | 8/1965 | Black | 222/39 |
| 4,086,589 | 4/1978 | Cieslak et al. | 340/384 E |
| 4,214,674 | 7/1980 | Jones et al. | 222/401 |
| 4,239,129 | 12/1980 | Esposito | 222/79 |

*Primary Examiner*—H. Grant Skaggs
*Attorney, Agent, or Firm*—John A. Beehner

[57] ABSTRACT

A toy squirt gun which shoots a continuous high velocity stream of water. The squirt gun is configured as a structure facilitating partial filling with water leaving a void for compressed air. The squirt gun includes a nozzle for ejecting water at high velocity, a pressurization pump for compressing air into the gun to pressurize water contained therein, and a trigger actuated flow control valve for shooting the gun by controlling flow of pressurized water through the nozzle. A battery-powered oscillator circuit and a water flow powered sound generator produce futuristic space ray gun sound effects when the gun is shooting.

9 Claims, 7 Drawing Figures

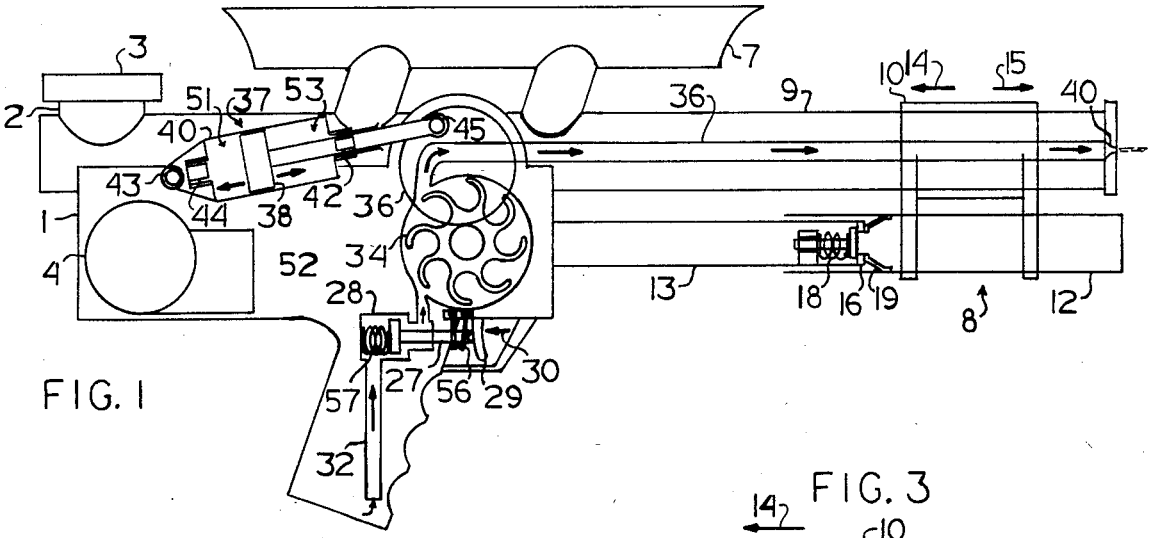
FIG. 1
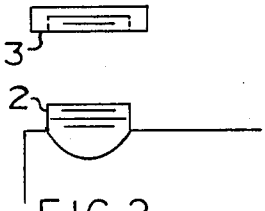
FIG. 2
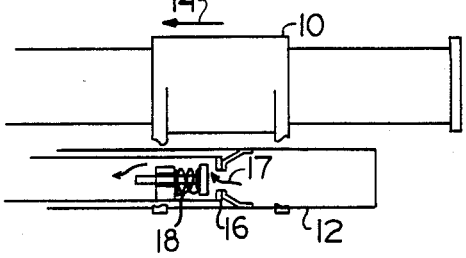
FIG. 3
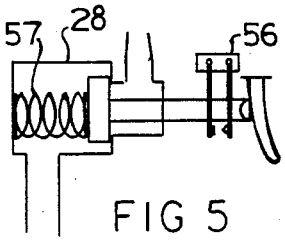
FIG 5
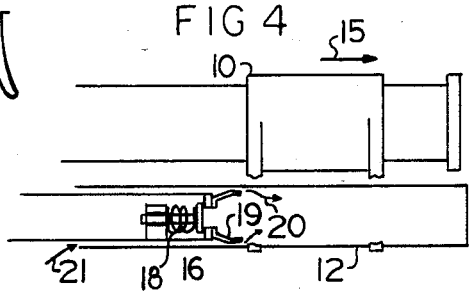
FIG 4
FIG. 6
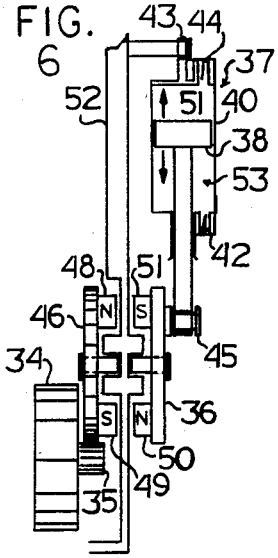
FIG. 7
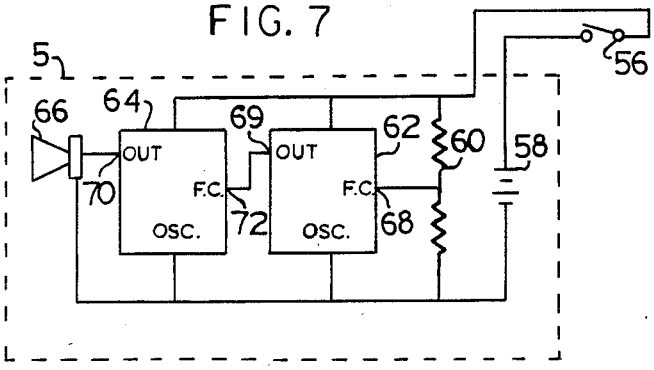

SQUIRT GUN

BACKGROUND AND SUMMARY

The principle utilizing compressed gas as a means for pressurizing water to effect a continuous stream of high velocity waterflow from a nozzle is common practice. However, the embodiment of this principle in a hand-held toy squirt gun having a futuristic space ray gun appearance and including sound effects is novel.

Compressed air is provided by a manually actuated air pump physically mounted underneath the gun barrel. Sound is produced by a battery-powered electronic oscillator circuit. Sound is also produced by a flow actuated sound generator.

To shoot the gun, a trigger is actuated to open a flow control valve and thereby permit pressurized waterflow through a nozzle. The water exits the nozzle and thereby the squirt gun at high velocity. The flow actuated sound generator is functionally coupled in series with the flow control valve and the nozzle to facilitate actuation of the sound generator by flowing water when the gun is shooting.

The waterflow rotates an impeller which is mechanically linked to a vibration means consisting of a piston in a cylinder to effect back and forth motion of the piston and thereby pump air alternatingly through a pair of vibrating reed-type horns to produce sound.

A switch coupled to the trigger is actuated simultaneously with opening of the control valve to switch on the oscillator circuit to produce sound.

BRIEF DESCRIPTION OF THE DRAWINGS

FIG. 1 is a functional diagram of an embodiment of the invention showing actuation of the trigger to shoot the gun.

FIG. 2 shows the resealable cap of the water fill port removed.

FIG. 3 shows actuation of the pressurization pump in the compressive stroke.

FIG. 4 shows actuation of the pressurization pump to resupply air into the pump cylinder.

FIG. 5 shows the trigger actuated flow control valve in a closed state with the control switch for the oscillator circuit in the off position.

FIG. 6 shows additional details of the flow actuated sound generator. The drawing depicts magnetic coupling of motion of an impeller driven gear inside the gun to a flywheel on the outside.

FIG. 7 is a simplified diagram of a battery-powered oscillator circuit.

DETAILED DESCRIPTION AND PREFERRED EMBODIMENT

An in-depth understanding of the present invention can be derived from the following description with reference to the drawings.

FIG. 1 is a configuration drawing showing the major features of the squirt gun. Squirt gun structure means 1 is designed to contain water and air under high internal pressure. Structure means 1 also provides mounting support for various elements of the gun. A water fill port means comprised of port 2 and screw on cap 3 function as a resealable port for opening structure means 1 to put water in the gun and resealing so as to not permit leaks when the gun is operating under high internal pressure. Screw on cap 3 is shown removed in FIG. 2.

Air reservoir means 7 is designed as a rifle scope means to enhance appearance. It is an integral part of structure 1 and functions to prevent the gun from being completely filled with water. When the gun is held upright with the fill port open, reservoir 7 is above the maximum water level determined by the position of fill port 2 and contains air to insure there is always a volume inside the gun into which air can be compressed.

A manually operated pressurization pump means comprised of pressurization piston means 13, check valve means 16, seal 19, spring 18 and a movable member means comprised of grip 10 and pressurization cylinder means 12 functions to compress air into structure means 1 and thereby air reservoir 7. Grip means 10 provides hand-held support for the gun and is movably coupled by concentric cylinder mounting to gun barrel means 9 to permit sliding along the length of the barrel. Gun barrel 9 and piston 13 are integral parts of structure means 1 and provide additional internal volume for containing air and water. Air pump cylinder 12 forms the bottom portion of grip 10. Compressed air is pumped into structure means 1 by moving grip 10 and cylinder 12 back and forth along the barrel in a pump shotgun type action as depicted by arrows 14 and 15. The compressive stroke is in the direction of arrow 14 as shown in FIG. 3. As cylinder 12 is moved further onto piston 13, pressure inside cylinder 12 increases and opens check valve 16. The compressed air flows into structure means 1 as illustrated by arrow 17. Check valve 16 is normally held closed by spring 18. The refill stroke of cylinder 12 is shown in FIG. 4. As cylinder 12 is moved in the direction of arrow 15, piston 13 is withdrawn from cylinder 12 and ambient air is sucked into cylinder 12 past seal 19 as depicted by arrows 20 and 21. The gun is pressurized by repeating this cycle with back and forth motion of grip 10 along barrel 9. The maximum pressure reached inside the water gun is determined by the ratio of the maximum volume to minimum volume created inside pump cylinder 12.

As shown in FIG. 1, to shoot the water gun, control valve means 28 is opened by pressing trigger means 29 in the direction of arrow 30. Control valve means 28 is coupled to structure means 1 and includes movable shaft means 27 which extends external to structure means 1. Trigger means 29 is attached to shaft means 27. With valve 28 open, pressurized water flows into conduit means 32 and up through valve 28 from the bottom of the gun as the compressed air in the top part of the gun and in reservoir 7 expands. Pressurized water flow exiting valve 28 impinges impeller means 34 causing impeller 34 to rotate as pressurized water flows through to conduit means 36. The pressurized water flows through conduit 36 to nozzle means 40 and exits the gun at high velocity.

Futuristic space ray gun sounds are produced by a flow actuated sound generator means. The flow actuated sound generator means includes impeller 34, which is configured operably in series with valve 28 and nozzle 40 as described. Impeller 34 functions as a flow responsive means for extracting operating power for the sound generator from the pressurized water flow. Referring to FIG. 6, the flow actuated sound generator further includes vibration means 37, and a coupling means comprised of a first rotatable structure means represented by gear 46, a second rotatable structure means represented by flywheel 36, first magnetic means 48 and 49, and second magnetic means 50 and 51. Pinion 35 is attached to impeller 34, and mounted such that it meshes with gear 46 to mate impeller 34 to gear 46. Magnets 48 and 49 are fixed to gear 46, and magnets 50 and 51 are fixed to flywheel 36. Magnets 48, 49, 50 and 51 are mounted such that the mutual attraction of opposite poles maintain a fixed relative orientation of flywheel 36 to gear 46 so that rotation of gear 46 causes rotation of flywheel 36. The magnetic coupling allows relatively low torques produced by impeller 34 to be efficiently coupled to flywheel 36 without friction losses associated with a pressure seal around a shaft. There is no hole through wall 52 which could cause loss of pressure. Wall 52 functions as a baffle means which prevents leakage through impeller 34. Vibration means 37 is comprised of a horn pump means which is represented by horn cylinder means 40 and horn piston means 38, and a horn vibrator means represented by a reed means which includes first reed vibrator means 42 and second reed vibrator means 44. Cylinder 40 is attached to wall 52 at pivot joint 43. Piston 38 is mounted inside cylinder 40 and mated to flywheel 36 at pivot joint 45. As flywheel 36 rotates when the gun is shooting, it moves piston 38 back and forth inside cylinder 40 causing air to be alternatingly pumped in and out of cavities 51 and 53 past reed vibrators 44 and 42, respectively. When piston 38 is moving in a direction forcing air out of cavity 53, air passes out past reed 42 causing reed 42 to vibrate creating a high pitch sound. Air is simultaneously sucked into cavity 51 past reed 44. With continued rotation of flywheel 36, motion of piston 38 is reversed forcing air out of cavity 51 past reed 44 and thereby producing a high pitch sound. Air is simultaneously sucked into cavity 53 past reed 42. The cycle is repeated continuously producing pulsating high frequency sound to create futuristic effects when the gun is shooting. Vibration means 37 is isolated from the pressurized water within structure 1 to allow efficient coupling of the sound vibrations it produces to the ambient air surrounding the gun.

Additional sound is produced by an electronic sound generator means represented by battery-powered oscillator circuit means 5 shown in FIG. 7. Circuit means 5 is housed in compartment 4 which is attached to structure means 1 as shown in FIG. 1. When trigger 29 is moved in the direction of arrow 30 to shoot the gun, switch means 56 is closed simultaneously and oscillator circuit 5 is switched on. As shown in FIG. 5, when trigger 29 is released, spring 57 closes valve 28 and allows switch 56 to open.

Referring to FIG. 7, battery-powered oscillator circuit means 5 is comprised of an electrical power source means represented by battery 58, and an electronic oscillator means represented by series resistor voltage divider 60, first oscillator means 62, second oscillator means 64, and a sound transducer means represented by speaker 66. The on-off state of circuit 5 is controlled by switch 56. When switch 56 is closed, operating power from battery 58 is coupled to oscillators 62 and 64 and voltage divider 60. Voltage divider 60 supplies a fixed voltage to frequency control voltage input means 68 of oscillator 62. Oscillator 62 operates at a significantly lower frequency than oscillator 64. The varying voltage at output 69 of oscillator 62 is coupled to frequency control voltage input means 72 of high frequency oscillator 64. The voltage at output 70 of oscillator 64 drives speaker 66. The high frequency at output 70 of oscillator 64 varies with the control voltage at input 72 and drives speaker 66 to produce varying high frequency sound to create futuristic space ray gun effects.

What is claimed is:

1. A toy squirt gun for shooting a continuous stream of water, comprising:

(a) a structure means for containing water and air under high internal pressure, said structure means being configured to facilitate partially filling with water leaving an internal volume for compressed air, a water fill port means, a pressurization pump means, a trigger means, a flow control valve means, a battery-powered oscillator circuit means, a flow actuated sound generator means and a nozzle means;

(b) said fill port means being attached to said structure means and including a removable cap corresponding to an aperture in said structure means, whereby said fill port means provides access for partially filling said squirt gun with water, the cap being resealable so as to not permit leakage when said squirt gun is operating under high internal pressure;

(c) said pressurization pump means being operably coupled to said structure means, providing handheld support for said squirt gun and operating to compress air into said structure means, said pressurization pump means including a movable member means for facilitating manual actuation thereof;

(d) said nozzle means being coupled to said structure means, said flow control valve means being fluidly coupled via a passageway within said structure means to said nozzle means, said control valve controlling flow of pressurized water to said nozzle means; to shoot said squirt gun said trigger means being manually actuated to open said control valve means and thereby permit pressurized water flow through said nozzle means, said water flow exiting said nozzle means and thereby said squirt gun at high velocity;

(e) said flow actuated sound generator means including a rotatable impeller means mounted integral and within said structure means and interposed between said control valve means and nozzle means and adapted to rotate when flowing water moves from said control valve means to said nozzle means, and also including vibration means mounted externally on said structure means and operably coupled to said impeller means for activation upon rotation of said impeller means; wherein said vibration means comprises a horn cylinder means, a horn piston means, a first reed vibrator means and a second reed vibrator means, said first and second reed vibrator means being attached to said cylinder means, said piston means being positioned inside said cylinder means, rotation of said impeller means causing said horn piston means to cycle back and forth inside said horn cylinder means and thereby alternatingly force air through said first and second vibrator means causing said first and second vibrator means to vibrate and produce pulsating sounds; and (f) said battery operated oscillator circuit means being attached to said structure means and including a switch means for controlling on and off states of said circuit means, said switch means being coupled to said trigger means to simultaneously switch said circuit means to an on state when said trigger means is actuated to shoot said squirt gun, said circuit means operating to produce pulsating sounds when switched to an on state.

2. A toy squirt gun for shooting a high velocity stream of water as disclosed in claim 1 wherein said structure means further includes a rifle scope means mounted parallel to said barrel means to enhance the appearance of said squirt gun.

3. A toy squirt gun for shooting a high velocity stream of water as disclosed in claim 1 wherein said air reservoir means comprises a rifle scope configuration mounted parallel to said barrel means.

4. A toy squirt gun for shooting a high velocity stream of water as disclosed in claim 1 wherein said pressurization pump means is mounted underneath said barrel means.

5. A toy squirt gun for shooting a continuous stream of water, comprising:

(a) a structure means for containing water and air under high internal pressure, said structure means being configured to facilitate partially filling with water leaving an internal volume for compressed air, a water fill port means, a pressurization pump means, a trigger means, a flow control valve means, a battery-powered oscillator circuit means, a flow actuated sound generator means and a nozzle means;

(b) said fill port means being attached to said structure means and including a removable cap corresponding to an aperture in said structure means, whereby said fill port means provides access for partially filling said squirt gun with water, the cap being resealable so as to not permit leakage when said squirt gun is operating under high internal pressure;

(c) said pressurization pump means being operably coupled to said structure means, providing hand-held support for said squirt gun and operating to compress air into said structure means, said pressurization pump means including a movable member means for facilitating manual actuation thereof;

(d) said nozzle means being coupled to said structure means, said flow control valve means being fluidly coupled via a passageway within said structure means to said nozzle means, said control valve controlling flow of pressurized water to said nozzle means; to shoot said squirt gun said trigger means being manually actuated to open said control valve means and thereby permit pressurized water flow through said nozzle means, said water flow exiting said nozzle means and thereby said squirt gun at high velocity;

(e) said flow actuated sound generator means including a rotatable impeller means mounted integral and within said structure means and interposed between said control valve means and nozzle means and adapted to rotate when flowing water moves from said control valve means to said nozzle means, and also including vibration means mounted externally on said structure means and operably magnetically coupled to said impeller means for activation upon rotation of said impeller means;

(f) said battery operated oscillator circuit means being attached to said structure means and including a switch means for controlling on and off states of said circuit means, said switch means being coupled to said trigger means to simultaneously switch said circuit means to an on state when said trigger means is actuated to shoot said squirt gun, said circuit means operating to produce pulsating sounds when switched to an on state.

6. A toy squirt gun for shooting a continuous stream of water at high velocity, said squirt gun comprising:

(a) a structure means for containing water and air under pressure, a pressurization pump means configured to facilitate manual actuation thereof for compressing air into said structure means, a trigger means and a flow control valve means for facilitating manual control of shooting of said gun, a fill port means for providing access for partially filling said structure means with water, a nozzle means for increasing the velocity of said water flow stream as said stream is ejected from said gun when said gun is shooting;

(b) said structure means being configured as a gun in appearance and including a barrel means and an air reservoir means as integral parts thereof; said air reservoir means functioning to prevent said gun from being completely filled with water to insure there is always a volume inside said structure means into which air can be compressed;

(c) said pressurization pump means including a movable member means for facilitating manual actuation thereof and check valve means for permitting one-way flow of compressed air into said structure means, said movable member means being movably coupled to said structure means along said barrel means and being manually actuatable in a back and forth motion to effect pumping of air into said structure means, and said check valve means being fluidly interposed between said movable member means and said structure means and adapted to permit air flow into said structure means and to restrain air and water flow out of said structure means;

(d) said pressurization pump means further comprising a pressurization cylinder means attached to said movable member means, and a pressurization piston means attached to said container, both oriented parallel and adjacent said barrel means, said pressurization piston means being configured to extend into said pressurization cylinder means such that back and forth movement of said movable member means along said barrel means moves said piston means in and out of said cylinder means to effect pumping of air into said structure means;

(e) wherein said pressurization piston means comprises an integral part of said structure means and is hollow so as to provide additional volume for containment of pressurized air and water; and wherein said check valve means is operably mounted to said pressurization piston means and functions to facilitate one way flow of compressed air into said structure means from said pressurization cylinder means;

(f) said fill port means being attached to said structure means and including a removable cap corresponding to an aperture in said structure means, whereby said fill port means provides access for partially filling said squirt gun with water, the cap being resealable so as to not permit leakage when said squirt gun is operating under high internal pressure; and (g) said control valve means being fluidly coupled via a passageway within said structure means to said nozzle means, said control valve controlling flow of pressurized water to said nozzle means.

7. A toy squirt gun comprising:

(a) a gun shaped container for holding water and air under pressure, including a barrel portion with a nozzle in its free end, and a passageway within said barrel communicating between said nozzle and the contents of said container;

(b) said container including an access port for filling said container with water;

(c) a removable cap for sealing said access port;

(d) said container including an air reservoir portion which extends upward beyond the height of said access port, said air reservoir being located such that air will be trapped therein when said container is filled with water;

(e) means operably coupled to said container for manually pressurizing the contents of said container;

(f) a control valve operably mounted within said passageway for opening and closing said passageway, including a shaft connected to said valve which projects externally of said container;

(g) a trigger operably connected to said container and the externally projecting portion of said control valve shaft and adapted to open said control valve upon manual activation thereof;

(h) an impeller rotatably mounted within said passageway between said control valve and nozzle, said impeller adapted to rotate upon the movement of fluid within said passageway;

(i) a mechanical sound generator mounted to said container and magnetically connected to said impeller, said sound generator producing a sound in response to rotation of said impeller; and (j) an electronic sound generator mounted to said container and electrically connected to said trigger for activation upon pulling of said trigger.

8. A toy squirt gun comprising:

(a) a gun shaped container for holding water and air under pressure, including a barrel portion with a nozzle in its free end, and a passageway within said barrel communicating between said nozzle and the contents of said container;

(b) said container including an access port for filling said container with water;

(c) a removable cap for sealing said access port;

(d) said container including an air reservoir portion which extends upward beyond the height of said access port, said air reservoir being located such that air will be trapped therein when said container is filled with water;

(e) means operably coupled to said container for manually pressurizing the contents of said container, including:

a hollow piston portion mounted on said container and projecting therefrom, the hollow portion thereof communicating with contents of said container;

a check valve operably mounted in the free end of said piston for retaining air in said piston injected through said valve;

a hollow pressurization cylinder with one closed end, fitted on said piston like a sleeve for axial slidable movement, the inside diameter of said cylinder being slightly greater than the outside diameter of said piston to allow the entrance of air within said cylinder upon axial movement of said cylinder away from said container; and flexible seal means mounted on the end of said piston between the walls of said piston and cylinder and adapted to allow one way movement of air into said cylinder when said cylinder is moved axially away from said container;

(f) a control valve operably mounted within said passageway for opening and closing said passageway, including a shaft connected to said valve which projects externally of said container; and (g) a trigger operably connected to said container and the externally projecting portion of said control valve shaft and adapted to open sid control valve upon manual activation thereof.

9. The squirt gun of claim 8, further comprising:

an impeller rotatably mounted within said passageway between said control valve and nozzle, said impeller adapted to rotate upon the movement of fluid within said passageway; and a mechanical sound generator mounted to said container and magnetically connected to said impeller, said sound generator producing a sound in response to to rotation of said impeller.

* * * * *